US011772877B2

(12) United States Patent
Bouteloup et al.

(10) Patent No.: US 11,772,877 B2
(45) Date of Patent: Oct. 3, 2023

(54) DEVICE FOR PACKAGING AT LEAST ONE FLUID

(71) Applicant: CORADIN SAS, Mouans-Sartoux (FR)

(72) Inventors: David Bouteloup, Peymeinade (FR); Fabrice Bourdier, Montauroux (FR); Florence Bidamant, Mulhouse (FR)

(73) Assignee: CORADIN SAS, Mouans-Sartoux (FR)

( * ) Notice: Subject to any disclaimer, the term of this patent is extended or adjusted under 35 U.S.C. 154(b) by 0 days.

(21) Appl. No.: 17/283,220

(22) PCT Filed: Oct. 10, 2019

(86) PCT No.: PCT/FR2019/052401

§ 371 (c)(1),
(2) Date: Apr. 6, 2021

(87) PCT Pub. No.: WO2020/079351

PCT Pub. Date: Apr. 23, 2020

(65) Prior Publication Data

US 2021/0380328 A1 Dec. 9, 2021

(30) Foreign Application Priority Data

Oct. 17, 2018 (FR) ..... 1871200

(51) Int. Cl.
*B65D 83/00* (2006.01)
*B65D 8/00* (2006.01)
*B65D 51/24* (2006.01)

(52) U.S. Cl.
CPC ..... *B65D 83/0094* (2013.01); *B65D 11/04* (2013.01); *B65D 51/249* (2013.01)

(58) Field of Classification Search
CPC ... B65D 83/0094; B65D 11/04; B65D 51/249
(Continued)

(56) References Cited

U.S. PATENT DOCUMENTS 901,100 A * 10/1908 Heitman ..... 604/212
1,575,567 A * 3/1926 Geake ..... B65D 83/0094 222/92

(Continued)

FOREIGN PATENT DOCUMENTS

DE 26 08 794 A1 9/1976
WO WO-95/27544 A1 10/1995
WO WO-2015/121275 A1 8/2015

OTHER PUBLICATIONS

International Search Report and Written Opinion issued in International Application No. PCT/FR2019/052401 dated Jan. 23, 2020.

*Primary Examiner* — Lien M Ngo
(74) *Attorney, Agent, or Firm* — FOLEY & LARDNER LLP

(57) ABSTRACT

The present invention relates to a device provided with a chamber that makes it possible to package at least one fluid, said chamber having a substantially ovoid form and comprising a first part made of a rigid material and a second part made of a flexible material, wherein the first part, made of a rigid material, comprises a dispenser that makes it possible to dispense said at least one fluid and wherein the second part, made of a flexible material is suitable for being deformed, thus making it possible to expel said at least one fluid from said device, by means of the dispenser.

9 Claims, 10 Drawing Sheets

(58) Field of Classification Search
USPC ..... 222/95, 92, 107, 206, 214, 215, 541.1, 222/541.6, 541.5, 96, 97; 215/249, 250, 215/253; 220/265, 266
See application file for complete search history.

(56) References Cited

U.S. PATENT DOCUMENTS

| | | | | | |
|---|---|---|---|---|---|
| 1,971,345 | A * | 8/1934 | Hein | A61M 3/00 | 604/212 |
| 4,072,249 | A * | 2/1978 | Ekenstam | A61M 5/282 | 222/107 |
| 4,153,185 | A * | 5/1979 | Nilson | B65D 83/0094 | 222/212 |
| 4,723,671 | A * | 2/1988 | Mears | B65D 51/249 | 215/228 |
| 6,463,968 | B1 * | 10/2002 | Hattori | B65B 5/106 | 141/369 |
| 7,059,487 | B2 * | 6/2006 | Ohlsson | B65D 1/0292 | 215/381 |
| 2003/0140936 | A1 * | 7/2003 | Yuhara | A45D 33/003 | 132/307 |
| 2006/0186139 | A1 * | 8/2006 | Laidler | B65D 83/7535 | 222/207 |
| 2009/0139954 | A1 * | 6/2009 | Ekkert | B65D 41/3423 | 215/253 |
| 2010/0200616 | A1 * | 8/2010 | Decottignies | B05B 11/0072 | 222/207 |
| 2011/0174835 | A1 | 7/2011 | Mamiye | | |
| 2013/0292414 | A1 * | 11/2013 | Sutherland | A47K 5/1201 | 222/107 |

* cited by examiner

[Fig. 1]
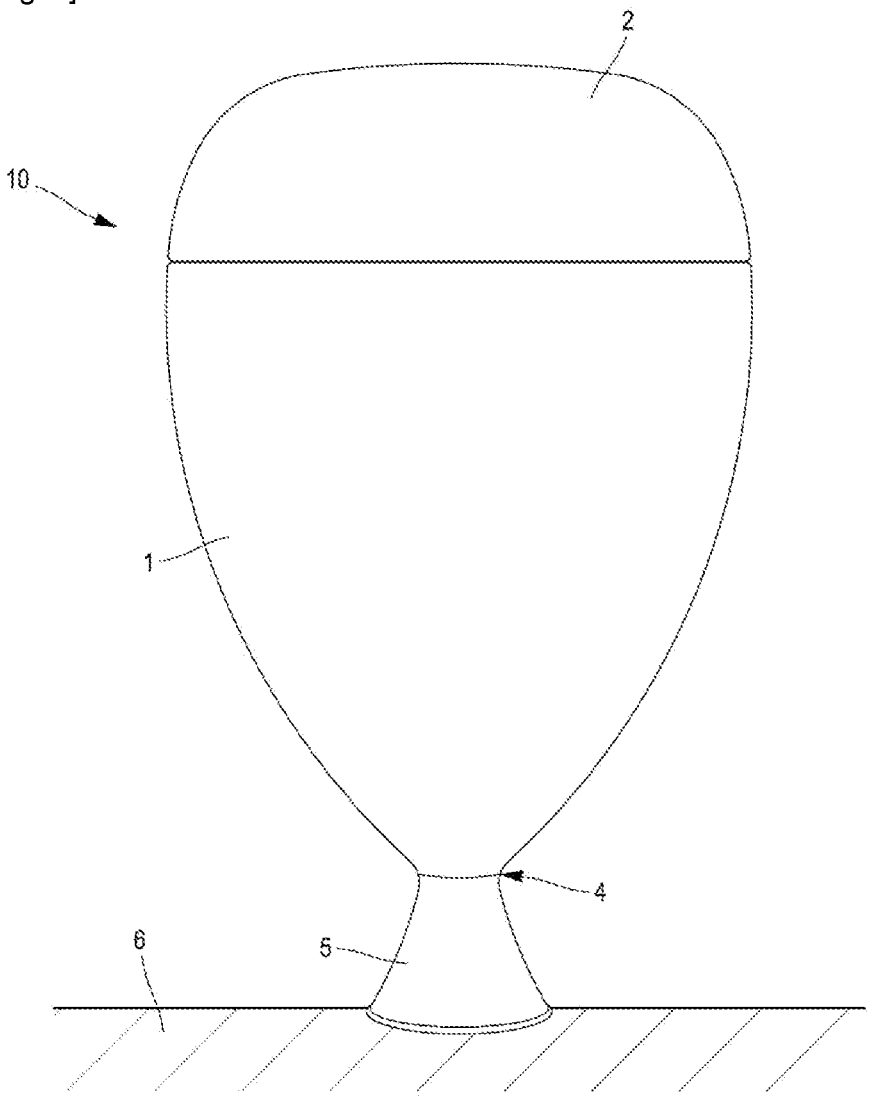

[Fig. 2]
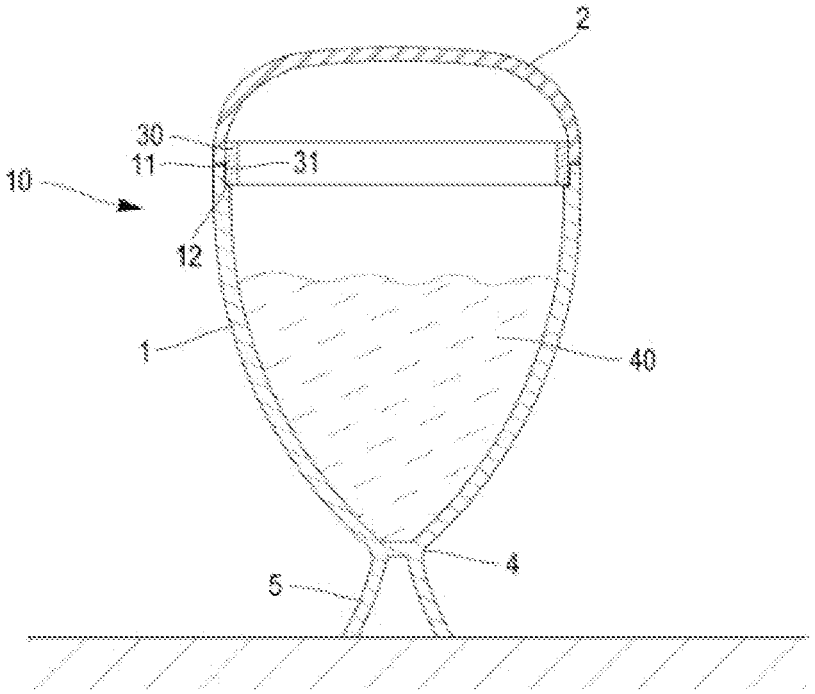

[Fig. 3]
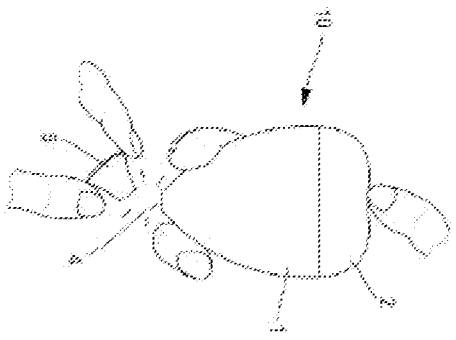

[Fig. 4]
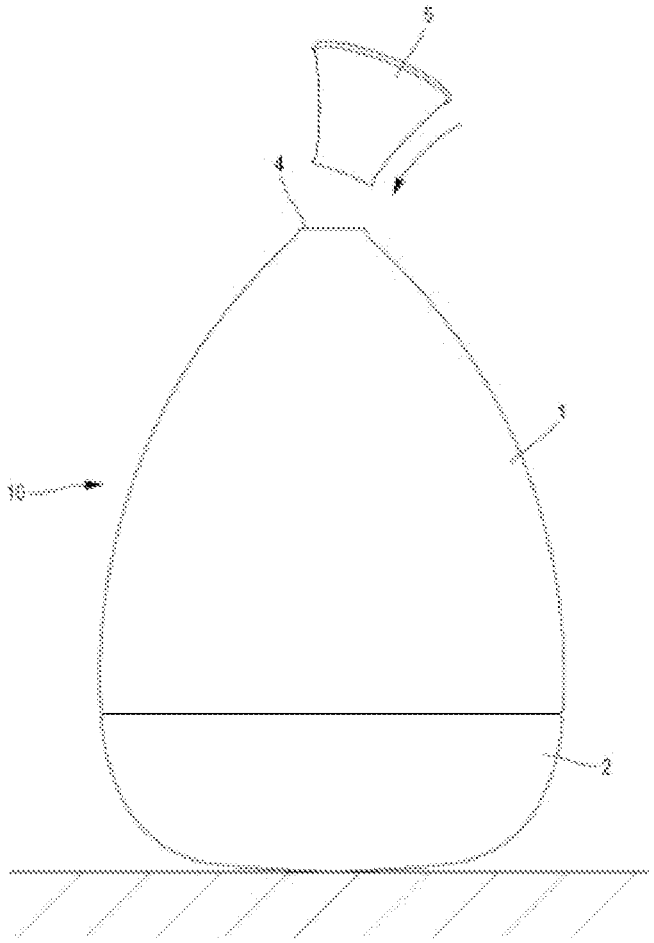

[Fig. 5]
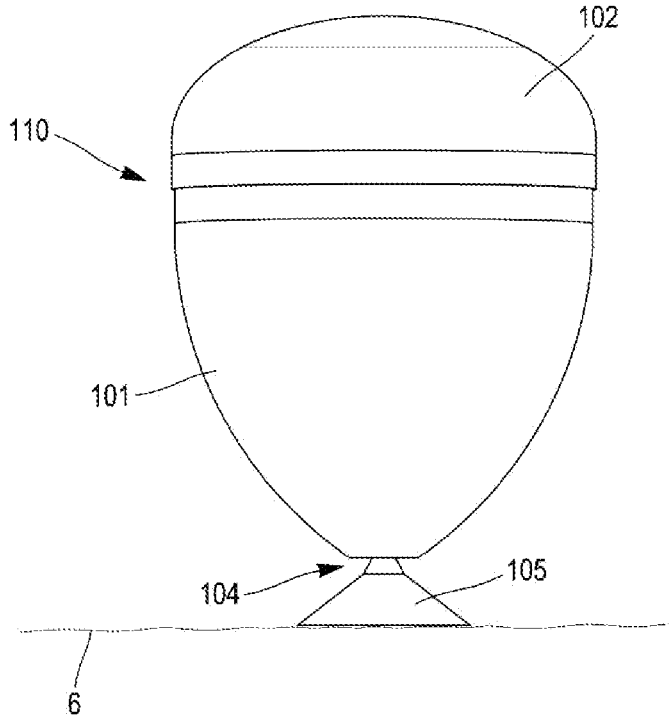

[Fig. 6]
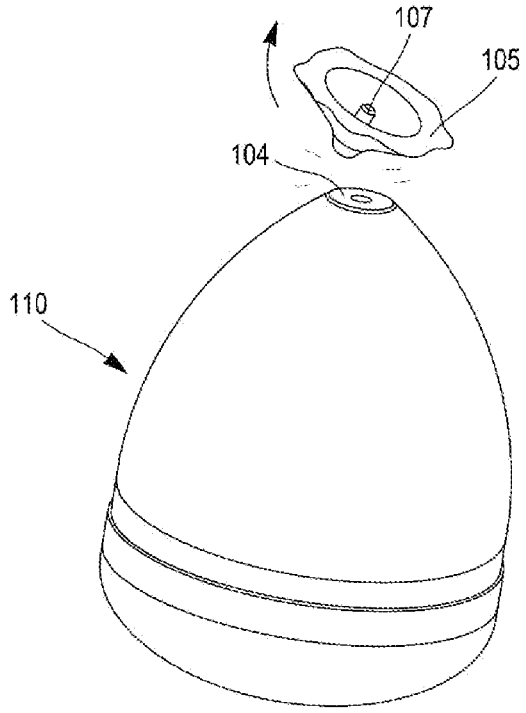

[Fig. 7]
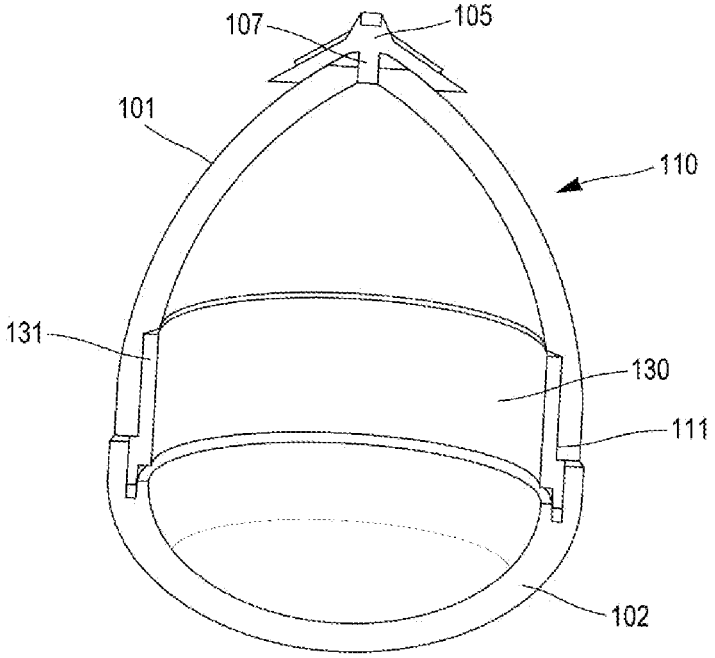

[Fig. 8]
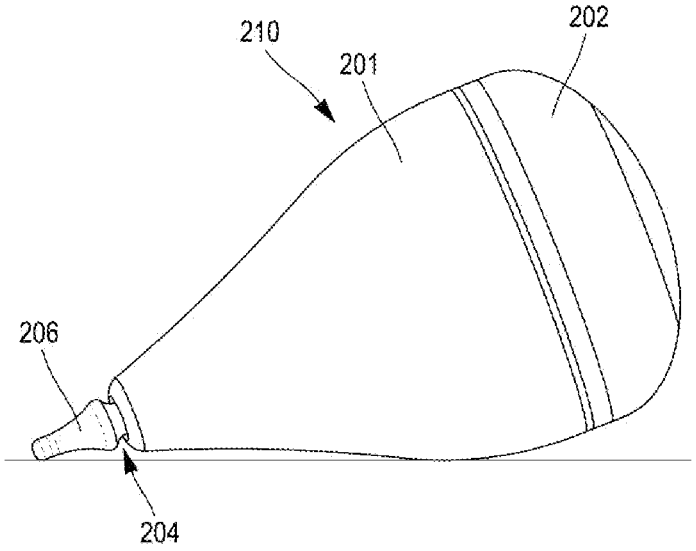

[Fig. 9]
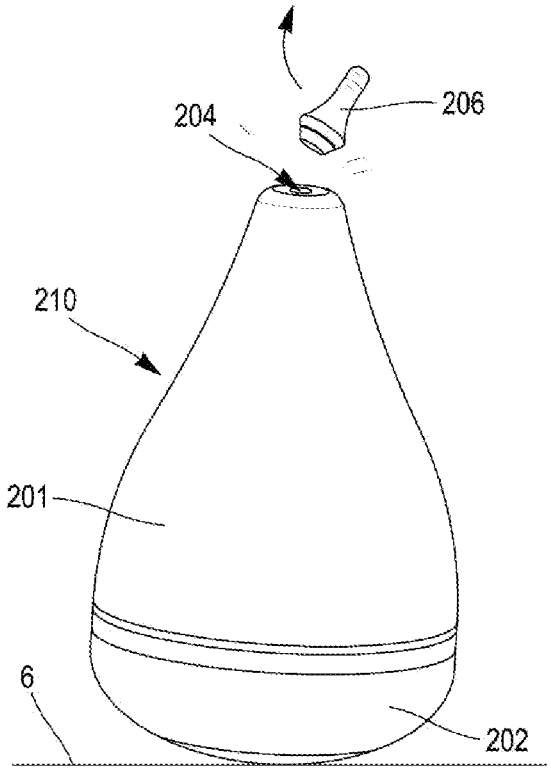

[Fig. 10]
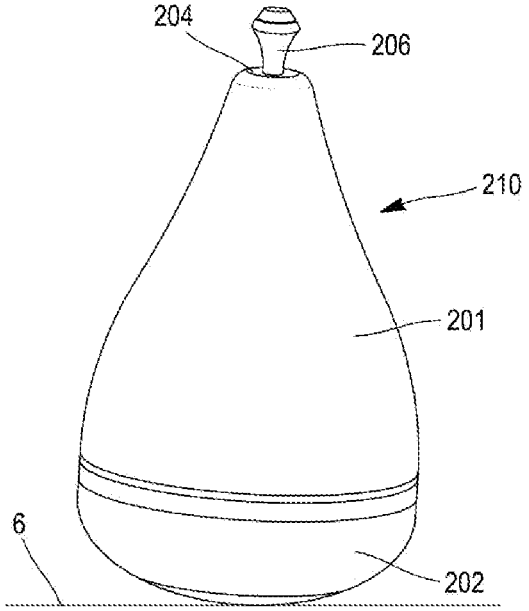

DEVICE FOR PACKAGING AT LEAST ONE FLUID

CROSS REFERENCE TO RELATED-APPLICATIONS

This application is a U.S. National Phase Application of International Application No. PCT/FR2019/052401, filed Oct. 10, 2019, which claims the benefit of French Patent Application No. 1871200, filed Oct. 17, 2018, the entire contents of both of which are hereby incorporated by reference in their entirety.

FIELD OF THE INVENTION

The invention relates to a device provided with a chamber that makes it possible to package at least one fluid, said chamber having a substantially ovoid form and comprising a part made of rigid material and a part made of flexible material.

STATE OF THE ART

Devices that make it possible to package at least one fluid and that comprise a part made of rigid material and a part made of flexible material are already known in the prior art. Said devices, which are provided with a part made of rigid material, comprise a dispenser that makes it possible to dispense the contents of said devices, and with a part made of flexible material that is suitable for being deformed so as to expel the contents of said devices.

The devices as described above are disclosed, for example, within the publication of American patent application US 2011/0174835. The device according to US 2011/0174835 is provided with a chamber that makes it possible to package at least one fluid, said chamber being produced from an entirely flexible material. A rigid part was secured onto the outer wall of said chamber, which rigid part is provided with a dispenser that makes it possible to dispense the contents of the device, said dispenser being able to be closed up using a cap.

The device, as disclosed within the prior art, is suitable for packaging, for example, a cosmetics product or a medicine. In order to release the fluid contained within the device known from the prior art, the user may remove the cap, exert pressure on the outside of the flexible wall of the chamber containing said fluid, expelling said fluid to the outside.

The device known from the prior art has a distinctive characteristic according to which the compartment situated inside said device, and intended to receive a fluid, is entirely produced using a flexible material. This means that to expel said fluid to the outside, the outer wall of said device must be completely flattened so as to ensure the expulsion of the contents of the device according to the prior art. This expulsion, which is the result of the flattening of the outer wall, may be produced by positioning the device according to the prior art on a support, such as a table, and by using the fingers to push on said device so as to expel a maximum of contents of said device to the outside.

Alternatively, the flexible wall of the device according to the prior art may be wound onto itself so as to extract a maximum amount of fluid from said device.

It should be noted that the device, as described in the prior art, has a drawback associated with the complexity of its production, its manufacture requiring two independent elements. Moreover, the presence of a cap that makes it possible to close up said device does not ensure tamper-proof security. In order to guarantee the tamper-resistance of the device before it is used for the first time, said cap must be provided with a specific element, such as a tamper-proof ring.

In addition, in order to be able to correctly empty the device known from the prior art, the user must use his/her two hands in order to compress the chamber comprising said at least one fluid.

Taking the above observations into account, the aim of the present invention consists in providing a device comprising a chamber that makes it possible to package at least one fluid, said chamber being composed of a part made of rigid material and a part made of flexible material. The device therefore has the advantage of ensuring simple and easy-to-handle release of a fluid to outside said device.

SUBJECT OF THE INVENTION

The subject of the invention is a device provided with a chamber that makes it possible to package at least one fluid, said chamber having a substantially ovoid form and comprising a first part made of a rigid material and a second part made of a flexible material, wherein the first part made of rigid material comprises a dispenser that makes it possible to dispense said at least one fluid and wherein the second part made of flexible material is suitable for being deformed, thus making it possible to expel said at least one fluid from said device by means of the dispenser, wherein said device comprises a linking element that makes it possible to connect the first part made of rigid material and the second part made of flexible material, said linking element being made substantially of a material similar to that used for the first part, made of rigid material, of the device, wherein said linking element is suitable for being assembled on the first part made of rigid material and wherein the second part made of flexible material is secured onto said linking element.

According to an embodiment of the invention, the second part made of flexible material is secured onto the linking element by means of an overmoulding method.

According to an embodiment of the invention, the device comprises a closing element that makes it possible to close up said dispenser wherein the closing element is connected to the first part made of rigid material by virtue of a frangible connection.

According to an embodiment of the invention, the closing element is in the form of a foot that makes it possible to position the device on a support by means of said foot.

According to an embodiment of the invention, the device is provided with a closing element that is suitable for closing up the dispenser with said closing element in a first position and wherein said closing element, after the device is opened for the first time, is suitable for closing up said dispenser with said closing element in a second position.

According to an embodiment of the invention, the foot is connected to the first part, which is made of rigid material to make it possible for said device to be positioned on the foot with the second part, made of flexible material, of the device situated on top of the first part, made of rigid material.

According to an embodiment of the invention, the second part, made of flexible material is in a rounded form to make it possible for the device to be positioned on a support using said second part, made of flexible material, wherein the weight of said second part, made of flexible material and the weight of the first part, made of rigid material are distributed so as to give the device the functionality of a roly-poly, once positioned on said second part, made of flexible material.

According to an embodiment of the invention, the part made of flexible material is connected to the part made of rigid material by means of a chemical connection.

BRIEF DESCRIPTION OF THE DRAWINGS

The aim, subject and characteristics of the invention will become more clearly apparent on reading the following description with reference to the figures, in which:

FIG. 1 shows a first embodiment of the device according to the invention, provided with a chamber that makes it possible to package at least one fluid, FIG. 2 depicts a cross-sectional view of the device according to FIG. 1, FIG. 3 shows the opening of the device according to FIGS. 1 and 2, FIG. 4 depicts the use of the device according to the invention after it is opened for the first time, FIG. 5 shows a second embodiment of the device according to the invention, FIG. 6 depicts the second embodiment according to FIG. 5, after the dispenser is opened, FIG. 7 shows a cross-sectional view of the device according to the second embodiment of the invention, after the dispenser is closed using the foot of said device, FIG. 8 depicts a third embodiment of the device according to the invention, FIG. 9 shows the third embodiment of the device according to the invention, after the dispenser is opened, and FIG. 10 depicts the third embodiment of the device according to the invention, after the dispenser is closed by means of the upended closing element.

FIG. 1 shows a first embodiment of a device 10 comprising a chamber that makes it possible to package at least one fluid according to the invention. Said device 10 has a substantially ovoid form, with the first part 1 made of rigid material and the second part 2 made of flexible material. The connection between said first part 1, made of rigid material, and said second part 2, made of flexible material, is described in more detail with reference to FIG. 2.

In the context of the present description, the word "ovoid" is used to refer to a form having substantially the form of an egg. The form is neither truly round nor truly oval. The ovoid form, as used within the present description may describe the form of an inflated balloon and also the form of a drop of water.

As shown in FIG. 1, the first part 1 made of rigid material comprises a dispenser 4 having the function of dispensing the fluid packaged within the device 10 to the outside. Said dispenser 4 is, prior to the first use of the device 10, closed up with the aid of a closing element 5 that is in the form of a foot, said foot 5 making it possible to position said device 10 on a support 6 such as a table.

As depicted in FIG. 1, the ensemble consisting of the first part 1, the second part 2 and the foot 5 gives the device 10 according to the invention an outer form that resembles an inflated balloon. The functionality of the device 10 is described in more detail in the paragraphs below.

FIG. 2 depicts a cross-sectional view of the device 10 according to FIG. 1. FIG. 2 shows that the foot 5 and the first part 1 of said device 10 together form a single element prior to the first use of the device 10. The first part 1 comprises a substantially circular lip 11 suitable for cooperating with a protrusion 31 of a linking element 30. The linking element 30 is suitable for connecting the second part 2 made of flexible material to the first part 1 made of rigid material. The linking element offers two functionalities. First of all, the linking element 30 serves to secure the second part 2 onto said linking element 30 by means of an overmoulding process. This means that the second part 2 is connected to said linking element 30 in a secure and sealed manner. The linking element 30 is provided with a protrusion 31. The linking element 30 is composed of a material substantially similar to the material used for the first part 1. In order to assemble the second part 2 on the first part 1, the ensemble of the second part 2 and the linking element 30, which is introduced inside the first part 1 at the circular lip 11, is pressed into the first part 1 until the protrusion 30 has passed the circular lip 11. Since the material that the first part 1 and the linking element 30 are composed of is relatively rigid, the protrusion 31 passes the circular lip 11 after an elastic deformation of said material that said first part 1 and/or said linking element 30 are composed of. The distance that the linking element 30 can enter into the first part 1, is limited by virtue of an abutment 12.

Since the ensemble of the linking element 30 and the second part 2 is introduced and secured onto the first part 1, the securing between said first part 1 and the linking element 30 is guaranteed by the presence of the circular lip 11, and the protrusion 31. The energy stored in the two elements enables a sealed securement between the linking element 30 and the first part 1 at said circular lip 11 and at the protrusion 31.

According to an alternative embodiment, not shown in the figures, the linking element 30 may be screwed onto the first part 1.

The connection of said first part 1 and the linking element 30, by means of the combination of the circular lip 11 and the protrusion 31, may be obtained by virtue of the combination of a mechanical and chemical securement.

FIG. 2 shows, schematically, the presence of a fluid 40 inside the device 10. As depicted in FIG. 2, the fluid 40 is positioned in an upright position (as shown in FIGS. 1 and 2) so as to be in direct contact with the dispenser 4. This means that before it is used for the first time, the fluid 40 is situated close to the dispenser 4 so as to facilitate the dispensing thereof to the outside, after said dispenser 4 is opened by removing the foot 5.

Referring to FIGS. 1 and 2, the device 10 is particularly easy to handle, the internal volume of said device 10 being obtained by virtue of the combination of the first part 1, made of rigid material, and the second part, made of flexible material. After the dispenser 4 is opened, the user may dispense the fluid 40 to outside the device 10 by pressing with his/her finger on the second part 2 made of flexible material. Considering the size of the device 10, as depicted more clearly in FIG. 3, the user may simultaneously hold the first part 1, made of rigid material, with the index finger and middle finger, while pressing on the second part 2, made of flexible material, with the thumb.

FIG. 3 shows a schematic view of the opening of the device 10. The user holds, with his/her first hand, said device 10 between the thumb, index finger and middle finger. Using his/her second hand, the user may remove the foot 5 from said device 10. Said device 10 is suitable for providing a frangibility that makes it possible to remove said foot 5, thus freeing the dispenser 4. When the foot 5 is withdrawn, the user may then extract the contents of the device 10 by exerting pressure with his/her thumb on the second part 2, made of flexible material, while holding, at the same time and with two fingers, the first part 1, made of rigid material.

As depicted in FIG. 3, before and after the dispenser 4 is opened, the fluid contained inside the device 10 is situated close to said dispenser 4. This means that, even if the viscosity of the fluid contained inside the device 10 is relatively substantial, the fluid may be expelled from said device 10 by exerting pressure with a finger onto the second part 2, made of flexible material.

FIG. 4 depicts the device 10 according to the invention after it has been opened for the first time. When the foot 5 has been removed from the first part 1, made of rigid material, the device 10 is suitable for being positioned, in a substantially upright position, on the second part 2, made of flexible material. The distribution of the weight of the first part 1, made of rigid material, and of the second part 2, made of flexible material is such that, when the device 10 according to the invention is positioned in a position as shown in FIG. 4, said device 10 has the functionality of a roly-poly. In the context of the present description, the term "roly-poly" is used so as to make reference to a device having a form that is wider at its base, namely the part that is in contact with the support 6, than at its top. Within the present description, the top of said "roly-poly" is formed by the dispenser 4. In addition, the mass that is unequally distributed relative to the height, is mainly concentrated at its base. The direct consequence thereof is that its centre of gravity is very low, which prevents the "roly-poly" from remaining in a reclining position even if the angle that it forms with the vertical is large. This property also results from the spherical form of the device as well as at a low coefficient of friction that exists between the base of the "roly-poly" and the support 6.

With reference to FIG. 4, the rounded form of the base of the "roly-poly" is supplied by the second part 2, made of flexible material, of the device 10. The functionality of the "roly-poly" is, in the position as shown in FIG. 4, enhanced because in said position, the fluid 40 (not shown in FIG. 4) is mainly situated in the second part 2, made of flexible material.

The technical effect of these measures is that, after it is used for the first time, the device 10 according to the invention may be set down and may remain in a stable position, on the second part 2, with the dispenser 4 remaining at the top of said device 10. This means that the at least one fluid cannot come out of the dispenser 4, even if the foot 5 is no longer present to close up said dispenser 4.

FIG. 5 shows a second embodiment of a device 110 according to the invention comprising a chamber that makes it possible to package at least one fluid. The chamber of said device 110 has a substantially "ovoid" form, with a first part 101, made of rigid material, and a second part 102, made of flexible material. The connection between said first part 101, made of rigid material, and said second part 102, made of flexible material, is described in more detail with reference to FIG. 7.

As shown in FIG. 5, the first part 101, made of rigid material comprises a dispenser 104 having the function of expelling the fluid packaged within the device 110 to the outside. Said dispenser 104 is, before the device 110 is used for the first time, closed up using a closing element 105 in the form of a foot. Said foot 105 makes it possible to position the device 110 on a support 6, such as a table, before said device 110 is used for the first time. As depicted in FIG. 5, the ensemble consisting of the first part made of rigid material 101, the second part made of flexible material 102 and the foot 105 gives the device 110 according to the invention an outer form that resembles an inflated balloon. The use of the device 110 is similar to the use of the device 10 described above.

FIG. 6 depicts a schematic view of the opening of the device 110. The user holds, using his/her first hand, said device 110 between the thumb, index finger and middle finger. Using his/her second hand, the user may remove the foot 105 from said device 110. Said device 110 is suitable for providing a frangibility that makes it possible to withdraw said foot 105, thus freeing the dispenser 104. When the foot 105 is withdrawn, the user may then extract the contents of the device 110 by exerting pressure on the second part 102, made of flexible material, with his/her thumb, while holding, simultaneously with the fingers, the first part 101 made of rigid material.

As shown in FIG. 6, the foot 105 comprises, inside it, a finger 107. The finger 107 is suitable for closing up the dispenser 104. In order to do this, the foot 105 is positioned in a position that is inverted in relation to its initial position so as to allow the finger 107 to enter the dispenser 104. The foot 105, thus secured onto the dispenser 104, prevents the fluid contained inside the device 110 from flowing inadvertently out of said device.

FIG. 7 shows a cross-sectional view of the device 110 after the dispenser 104 has been closed using the finger 107, said finger 107 being an integral part of the foot 105.

As shown in FIG. 7, the device 110 according to the invention is, after it is opened for the first time, suitable for being positioned in a substantially upright position on the second part 102, made of flexible material, the opening 104 being situated on the upper part of said device 110.

As already explained for the device 10, with reference to FIG. 4, the device 110 has the functionality of a "roly-poly". Since the contents of the device 110 are situated in the lower part of said device, in the position as shown in FIG. 7, the device 110 may be positioned in an upright position and retain its position so as to prevent the contents of said device 110 from flowing through the opening 104, after said device 110 is used for the first time.

FIG. 7 also depicts the linking element 130 that is used so as to enable a secure and sealed connection of the first part 101, made of rigid material, and of the second part 102, made of flexible material.

According to the present invention, the linking element 130 is substantially made using the same materials as the first part 101, made of rigid material. In order to obtain the various items, the linking element 130 is made, for example, by virtue of a mould that receives a plastics material. When the linking element 130 is completed, the second part 102, made of flexible material, may be made by virtue of an overmoulding process, during which the second part 102 is overmoulded on the linking element 130.

As shown in FIG. 7, the linking element 130 is provided with a part 131 that is suitable for coming into contact with the inner wall of the first part 101, made of rigid material. The form of the inner wall of the first part 101, made of rigid material, and the form of the outer wall of the part 131 of the linking element 130 are such that they enable a secure and sealed connection, by assembly, after the part 131 is introduced inside the first part 101, made of rigid material.

According to an alternative embodiment, the part 131 and the first part 101, which is made of rigid material, may be secured by means of a glue, a welding process or in any other suitable manner that makes it possible to obtain a secure and sealed securement between the part 131 and the first part 101.

FIG. 8 shows a third embodiment of the device 210 according to the invention, said device comprising a chamber that makes it possible to package at least one fluid. The device 210 comprises a first part 201, made of rigid material and a second part 202, made of flexible material. The first part 201 and the second part 202 are connected to one another by virtue of a linking element. Said linking element, which is not visible, may be in the same form, and may have the same functionalities as the linking element 30, 130, as described above, with reference respectively to the first and to the second embodiment of the device according to the invention.

The device 210 is provided with a dispenser 204 having the function of dispensing the fluid packaged within said device to the outside. Before the device 210 is used for the first time, said dispenser 204 is closed up using a closing element 206.

As shown in FIG. 8, the ensemble of the first part 201, made of rigid material, the second part 202 and the closing element 206 substantially gives the device 210 the appearance of a drop of water.

The use of the device 210 is comparable to the use of the device 10, according to a first embodiment and to the use of the device 110, according to a second embodiment of the invention.

The opening of the device 210 is depicted schematically in FIG. 9. The user may, with the fingers of a first hand, hold the first part 201 and/or the second part 202 of said device 210. The user may, with the fingers of the second hand, remove the closing element 206. When the closing element 206 is withdrawn, the dispenser 204 is open and may enable the dispensing of the fluid packaged within the device 210 to the outside. The dispensing may take place by holding the first part 201, made of rigid material, with the fingers, and by simultaneously pushing on the second part 202, made of flexible material, thus expelling the fluid contained within the device 210 to the outside by virtue of the dispenser 204.

When the user has the desired amount of fluid from the device 210, he/she may set said device 210 down, in a substantially upright position, as is shown in FIG. 10. In the position shown in FIG. 10, the device 210 rests, on the second part 202 made of flexible material, on a support 6 such as a table. In a substantially upright position, the dispenser 204 is directed upwards and is situated substantially on the upper part of the device 210. Said position makes it possible to prevent the fluid from inadvertently flowing out of said device 210. Moreover, as shown in FIG. 10, the closing element 206 is used in order to close up the dispenser 204. Indeed, the closing element 206 is in a position that is inverted in relation to its initial position before opening, as depicted in FIG. 8. Since the closing element 206 has a pointed form, it is therefore suitable for closing up the dispenser 204, thus avoiding any unintentional flow of the fluid out of the device 210 and ensuring the integrity of said fluid.

The invention claimed is:

1. A device provided with a chamber that makes it possible to package at least one fluid, said chamber having a substantially ovoid form and comprising a first part made of a rigid material and a second part made of a flexible material, wherein the first part made of rigid material comprises a dispenser that makes it possible to dispense said at least one fluid and wherein the second part made of flexible material is suitable for being deformed, thus making it possible to expel said at least one fluid from said device by the dispenser, characterised in that said device comprises a linking element positioned on an interior surface of the chamber that makes it possible to connect the first part made of rigid material directly to the second part made of flexible material, said linking element being made substantially of a material similar to that used for the first part, made of rigid material, of the device, wherein said linking element is suitable for being assembled on the first part made of rigid material, wherein the first part comprises a lip configured to receive a bottom part of the linking element, and wherein the second part made of flexible material is secured onto said linking element, and wherein the second part made of flexible material is secured onto the linking element by an overmoulding process creating a seal between the second part and the linking element, wherein the linking element fluidly couples the first part to the second part.

2. The device according to claim 1, wherein the device comprises a closing element that makes it possible to close up said dispenser, wherein the closing element is connected to the first part made of rigid material by virtue of a frangible connection.

3. The device according to claim 2, wherein said closing element is in the form of a foot that makes it possible to position the device on a support by said foot.

4. The device according to claim 1, wherein said device is provided with a closing element that is suitable for closing up the dispenser with said closing element in a first position and wherein said closing element, after the device is opened for the first time, is suitable for closing up said dispenser with said closing element in a second position.

5. The device according to claim 3, wherein the foot is connected to the first part, which is made of rigid material to make it possible for said device to be positioned on the foot with the second part, made of flexible material, of the device situated on top of the first part, made of rigid material.

6. The device according to claim 1, wherein the second part, made of flexible material is in a rounded form to make it possible for the device to be positioned on a support using said second part, made of flexible material, wherein the weight of said second part, made of flexible material and the weight of the first part, made of rigid material are distributed so as to give the device the functionality of a roly-poly, once positioned on said second part, made of flexible material.

7. A method for assembling a device provided with a chamber that makes it possible to package at least one fluid comprising:

assembling a linking element onto a first part comprising a lip, the lip configured to receive a bottom part of a linking element, wherein the linking element is positioned on an interior surface of the device;

securing the first part to the linking element by a first process, the first part made of a rigid material;

securing a second part to the linking element, the second part made of a flexible material, wherein the linking element couples the second part to the first part; and sealing the second part to the linking element by an overmoulding process.

8. The method of claim 7 wherein the first process is a chemical process.

9. The method of claim 7 wherein the first process is a mechanical process.

* * * * *